US007636952B2

(12) United States Patent
Fordham et al.

(10) Patent No.: US 7,636,952 B2
(45) Date of Patent: Dec. 29, 2009

(54) GLOVE AND INSERT COMBINATION

(76) Inventors: Pamela L. Fordham, 3508 Brightseat Rd., Landover, MD (US) 20785; Andre Miguel Fordham, 3508 Brightseat Rd., Landover, MD (US) 20785

( * ) Notice: Subject to any disclaimer, the term of this patent is extended or adjusted under 35 U.S.C. 154(b) by 0 days.

(21) Appl. No.: 11/897,856

(22) Filed: Aug. 31, 2007

(65) Prior Publication Data

US 2009/0055993 A1 Mar. 5, 2009

(51) Int. Cl.
*A41D 19/00* (2006.01)

(52) U.S. Cl. ..... 2/164; 2/162; 2/170; 2/161.1; 2/160

(58) Field of Classification Search ..... 2/162, 2/164, 160, 161.1, 170; D2/620, 621
See application file for complete search history.

(56) References Cited

U.S. PATENT DOCUMENTS

| | | | | | |
|---|---|---|---|---|---|
| 1,478,582 | A | * | 12/1923 | Schallman | 2/164 |
| 1,534,616 | A | * | 4/1925 | Steinberger | 2/162 |
| 1,934,332 | A | * | 11/1933 | Skinner | 2/162 |
| 2,418,887 | A | * | 4/1947 | Jones | 2/162 |
| D162,000 | S | * | 2/1951 | Breath | D2/620 |
| 4,757,557 | A | | 7/1988 | Hirano | |
| 4,757,558 | A | | 7/1988 | Strongwater | |
| 4,843,653 | A | | 7/1989 | Coble | |
| 5,070,544 | A | | 12/1991 | Alibertie et al. | |
| 5,234,725 | A | | 8/1993 | Smith | |
| D367,152 | S | | 2/1996 | Carp | |
| 5,542,125 | A | | 8/1996 | Zuckerwar | |
| D462,825 | S | * | 9/2002 | Kummings et al. | D2/621 |
| 6,449,772 | B1 | | 9/2002 | Donner | |
| D501,287 | S | | 2/2005 | French | |
| 2005/0183184 | A1 | * | 8/2005 | Hatch et al. | 2/161.1 |

* cited by examiner

*Primary Examiner*—Gary L Welch
*Assistant Examiner*—Alissa J Tompkins
(74) *Attorney, Agent, or Firm*—Raymond Sun

(57) ABSTRACT

A system includes a glove and a plurality of inserts, with each insert having a hand section and a border section. The user's hand is inserted into the interior of a first of the plurality of inserts, and then the hand section of the first insert is inserted inside the interior of the glove, with the border section of the first insert extending outside the glove. The user can then remove the glove and the first insert, and insert the user's hand into the interior of a second of the plurality of inserts, followed by inserting the hand section of the second insert inside the interior of the glove, with the border section of the second insert extending outside the glove.

3 Claims, 2 Drawing Sheets

GLOVE AND INSERT COMBINATION

BACKGROUND OF THE INVENTION

1. Field of the Invention

The present invention relates to clothing accessories, and in particular, to a glove and insert combination that allows a user to use different inserts with the same glove.

2. Description of the Prior Art

The fashion market covers not only conventional clothing items such as dresses, blouses, trousers, skirts and panels, but also includes accessories such as gloves, among others. Gloves are popular because they are quite visible, and can often enhance the appearance of a particular outfit chosen by the wearer.

Many people have a large collection of gloves which they use for different occasions. Unfortunately, gloves can be expensive, and there is often a desire for a woman to vary the appearance of her handwear. In this regard, it would be very expensive to buy a large collection of gloves.

Thus, there still remains a need for a system and a method for a woman to vary her handwear.

SUMMARY OF THE DISCLOSURE

To accomplish the objectives set forth above, the present invention provides a system and method of providing a different border for a glove. The system includes a glove and a plurality of inserts, each insert having a hand section and a border section. The user's hand is inserted into the interior of a first of the plurality of inserts, and then the hand section of the first insert is inserted inside the interior of the glove, with the border section of the first insert extending outside the glove. The user can then remove the glove and the first insert, and insert the user's hand into the interior of a second of the plurality of inserts, followed by inserting the hand section of the second insert inside the interior of the glove, with the border section of the second insert extending outside the glove. As a result, the present invention allows a user to wear a particular glove with a wide variety of borders.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
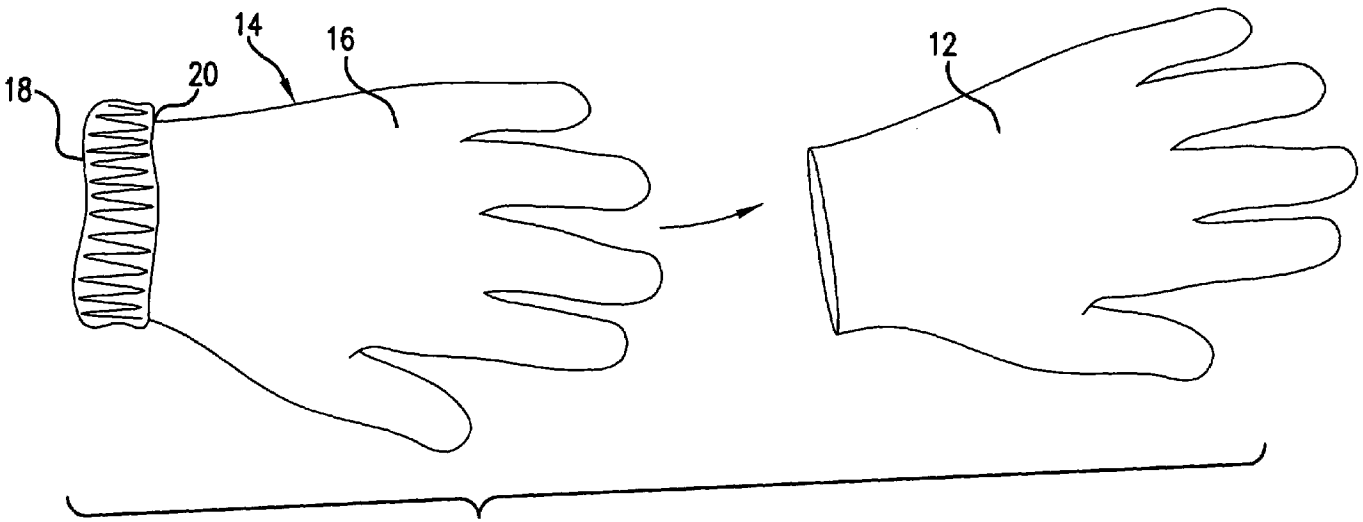
FIG. 1 is an exploded perspective view of a glove and an insert according to the present invention.
Figure 2:
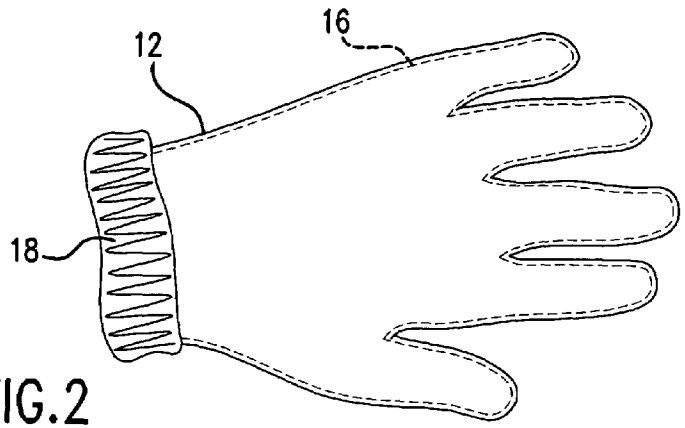
FIG. 2 is a perspective view of the combined glove and insert of FIG. 1 shown together in use.

FIGS. 1 and 2 illustrate a glove and insert combination 10, which includes a glove 12 and an insert 14. The glove 12 can be any conventional glove that is available in the marketplace. The glove 12 can be made of any fabric or leather. The insert 14 has a hand section 16 that itself resembles a glove that has finger sections, but which may be made from a lighter and softer material such as SPANDEX™ or UNDERARMOR™ material. A border section 18 is provided at the wrist end 20 of the hand section 16. The border section 18 can have a fanciful design or texture. For example, the border section 18 can be provided in different colors or designs, different materials (e.g., fur, cloth, fabrics or leather), and different thicknesses, sizes or shapes. The hand section 16 is typically sized and configured to fit inside any conventional glove 12.

In use, a user would insert the hand into the hand section 16 of the insert 14 via the border 18, and then insert the hand and the insert 14 into the interior of the glove 12 (see FIG. 2), so that the combination has an outward appearance of the glove 12 and the border 18, with the hand section 16 hidden inside the glove 12 and the border 18 exposed and extending outside the hand section 16. The border 18 would appear to be part of the glove 12.

Figure 3:
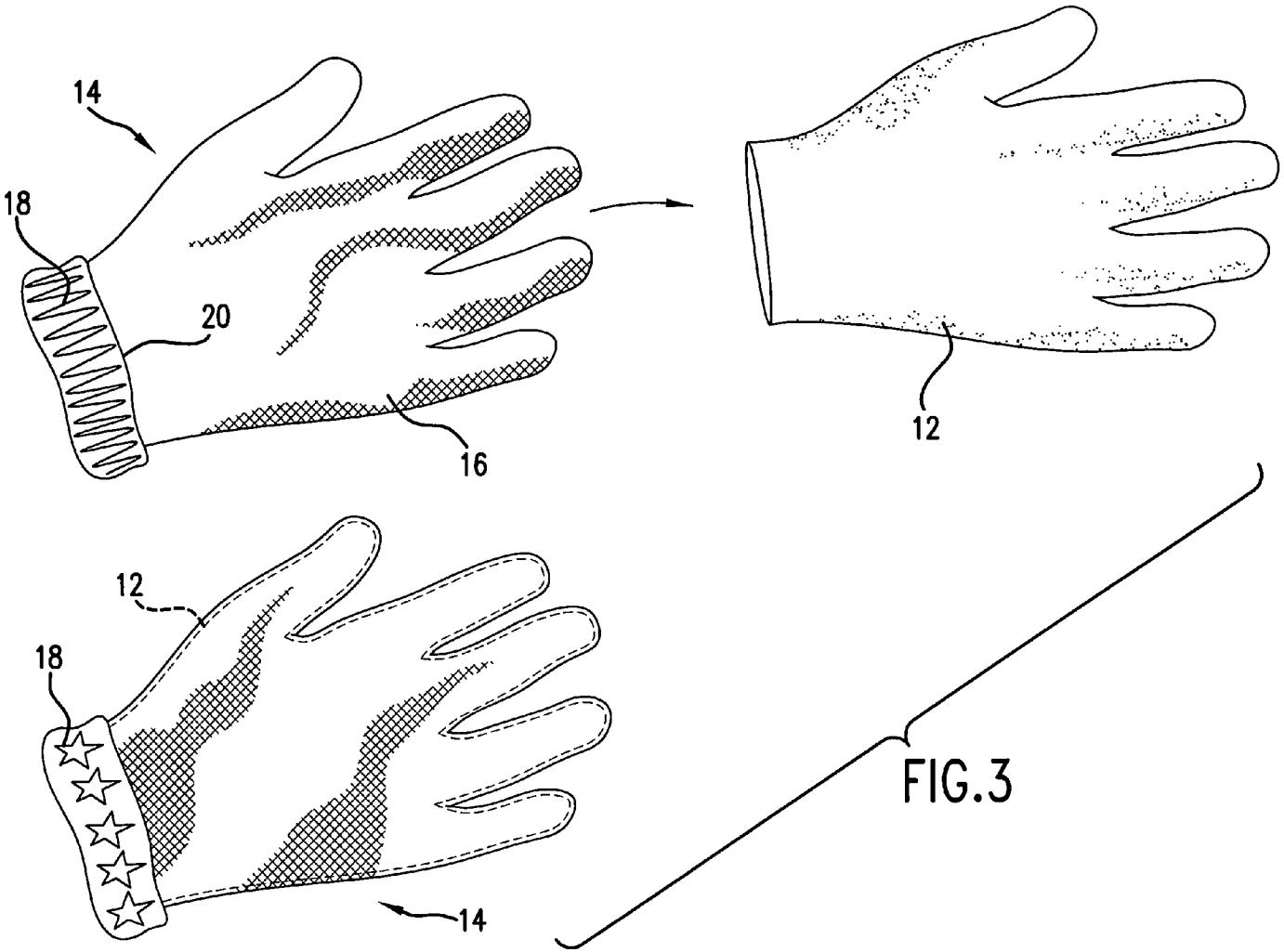
FIG. 3 is an exploded perspective view of a plurality of gloves and a plurality of inserts according to the present invention.

The present invention provides a system which includes a plurality of gloves 12 and a plurality of inserts 14, as shown in FIG. 3. As a result, the user can mix and match any glove 12 with any insert 14, so that different gloves 12 can be worn with different borders 18. This allows the user to match a specific glove 12 and insert 14 with any desired outfit.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A method of providing a different border for a glove, comprising:

providing a plurality of gloves, each having a plurality of finger sections and an interior, with each glove being different from each other;

providing a plurality of inserts, each insert having a plurality of finger sections, a hand section and a border section, the hand section having an interior that is adapted to receive a human hand, wherein:

the hand sections of the inserts are made from a different material from the materials of the gloves, the material for the hand sections of the inserts being lighter and softer than the materials for the gloves, each border section made from a material that is different from the materials of the hand sections and the gloves, and the border sections of each of the inserts is different;

inserting a user's hand into the interior of a first of the plurality of inserts with the user's fingers retained inside the finger sections of the first insert;

inserting the hand section of the first insert inside the interior of a first of the plurality of gloves, with the finger sections of the first insert being positioned inside corresponding finger sections of the first glove, and with the border section of the first insert extending outside the first glove;

removing the first glove and the first insert;

inserting a user's hand into the interior of a second of the plurality of inserts with the user's fingers retained inside the finger sections of the second insert; and inserting the hand section of the second insert inside the interior of the first glove, with the finger sections of the second insert being positioned inside corresponding finger sections of the first glove, and with the border section of the second insert extending outside the first glove.

2. A method of providing a different glove for a border, comprising:

providing a plurality of gloves, each having a plurality of finger sections and an interior, with each glove being different from each other;

providing a plurality of inserts, each insert having a plurality of finger sections, a hand section and a border section, the hand section having an interior that is adapted to receive a human hand, wherein:

the hand sections of the inserts are made from a different material from the materials of the gloves, the material for the hand sections of the inserts being lighter and softer than the materials for the gloves, each border section made from a material that is different from the materials of the hand sections and the gloves, and the border sections of each of the inserts is different;

inserting a user's hand into the interior of a first of the plurality of inserts with the user's fingers retained inside the finger sections of the first insert;

inserting the hand section of the first insert inside the interior of a first of the plurality of gloves, with the finger sections of the first insert being positioned inside corresponding finger sections of the first glove, and with the border section of the first insert extending outside the first glove;

removing the first glove;

inserting the hand section of the first insert inside the interior of a second of the plurality of gloves, with the finger sections of the first insert being positioned inside corresponding finger sections of the second glove, and with the border section of the first insert extending outside the second glove.

3. A method of providing a different border for different gloves, comprising:

providing a plurality of gloves, each having a plurality of finger sections and an interior, with each glove being different from each other;

providing a plurality of inserts, each insert having a plurality of finger sections, a hand section and a border section, the hand section having an interior that is adapted to receive a human hand, wherein:

the hand sections of the inserts are made from a different material from the materials of the gloves, the material for the hand sections of the inserts being lighter and softer than the materials for the gloves, each border section made from a material that is different from the materials of the hand sections and the gloves, and the border sections of each of the inserts is different;

inserting a user's hand into the interior of a first of the plurality of inserts with the user's fingers retained inside the finger sections of the first insert;

inserting the hand section of the first insert inside the interior of a first of the plurality of gloves, with the finger sections of the first insert being positioned inside corresponding finger sections of the first glove, and with the border section of the first insert extending outside the first glove;

removing the first glove and the first insert;

inserting a user's hand into the interior of a second of the plurality of inserts with the user's fingers retained inside the finger sections of the second insert; and inserting the hand section of the second insert inside the interior of a second of a plurality of gloves, with the finger sections of the second insert being positioned inside corresponding finger sections of the second glove, and with the border section of the second insert extending outside the second glove.

* * * * *